US006652183B2

(12) United States Patent
Stasiewich et al.

(10) Patent No.: US 6,652,183 B2
(45) Date of Patent: Nov. 25, 2003

(54) ROAD MATS

(76) Inventors: David Stasiewich, 60 Reichert Dr., Beaumont, Alberta (CA), T4X 1L3; James Stasiewich, 659 Lee Ridge Rd., Edmonton, Alberta (CA), T6K 0N9

( * ) Notice: Subject to any disclaimer, the term of this patent is extended or adjusted under 35 U.S.C. 154(b) by 0 days.

(21) Appl. No.: 10/014,305

(22) Filed: Nov. 13, 2001

(65) Prior Publication Data

US 2002/0176744 A1 Nov. 28, 2002

(30) Foreign Application Priority Data

May 23, 2001 (CA) ..... 2348328

(51) Int. Cl.[7] ..... E01C 5/16
(52) U.S. Cl. ..... 404/35; 404/41
(58) Field of Search ..... 404/41, 35; 14/14; D25/138; 52/125.2

(56) References Cited

U.S. PATENT DOCUMENTS 3,348,549 A * 10/1967 Harvey ..... 404/35
3,679,531 A * 7/1972 Wienand et al. ..... 138/111
4,594,829 A * 6/1986 Herrgord ..... 52/282.3
4,973,505 A * 11/1990 Bielous ..... 404/32
5,032,037 A * 7/1991 Phillips et al. ..... 404/35
5,050,362 A * 9/1991 Tal et al. ..... 404/41
5,204,149 A * 4/1993 Phenicie et al. ..... 220/1.5
5,215,802 A * 6/1993 Kaars Sijpesteijn ..... 15/215
5,810,511 A 9/1998 Schmidt
5,833,386 A * 11/1998 Rosan et al. ..... 404/36
D402,063 S * 12/1998 Dickey ..... D25/138
6,021,646 A * 2/2000 Burley et al. ..... 165/45
6,260,828 B1 * 7/2001 English ..... 256/21
6,324,796 B1 * 12/2001 Heath ..... 52/177

* cited by examiner

*Primary Examiner*—Thomas B. Will
*Assistant Examiner*—Kristine Florio
(74) *Attorney, Agent, or Firm*—Davis & Bujold, PLLC

(57) ABSTRACT

A road mat includes a body having a first end, a second end, a first face and a second face. A first coupling is positioned at the first end has an outwardly extending portion extending outwardly from the first end adjacent to the second face, an angled portion extending from a remote end of the outwardly extending portion toward but not past the first face, and an inwardly extending retaining lip extending from a remote end of the angled portion back toward the first end. A second coupling is positioned at the second end is similarly configured with an outwardly extending portion extending outwardly from the second end adjacent to the first face, an angled portion and an inwardly extending retaining lip. The retaining lip of the second coupling engages the retaining lip of the first coupling preventing separation.

16 Claims, 2 Drawing Sheets

ROAD MATS

FIELD OF THE INVENTION

The present invention relates to a road mat

BACKGROUND OF THE INVENTION

Road mats are designed to be laid onto a ground surface in end to end relation and driven over by motor vehicles. They formerly were used only where the ground surface was incapable of supporting the weight of a motor vehicle, such as in mud, swamp or muskeg. They are now also used in environmentally sensitive areas in order to reduce environmental damage.

It is important that the road mats do not shift after installation. Otherwise gaps occur and the road mats must constantly be realigned. In order to reduce movement, road mats are commonly manufactured mating engagements at either end. One such form of engagement is a first "L" shaped appendage extending outwardly and upwardly from a first end and a second "L" shaped appendage extending outwardly and downwardly from a second end of each mat. The engagement of the first "L" shaped appendage with the second "L" shaped appendage prevents axial movement. This engagement works effectively when the underlying surface is firm. However, when the underlying surface is soft, spongy or uneven, the engagement is not effective. On such surfaces the road mats tend to tip up when weight is exerted upon one end. This tipping movement is encountered both as a motor vehicle first drives onto one of the road mats and as the motor vehicle drives off the road mat. When subjected to this tipping movement, the road mats tend to separate.

SUMMARY OF THE INVENTION

What is required is a road mat with a more secure locking engagement that will not separate even when subjected to tipping caused by uneven load distribution on soft, spongy or uneven ground surfaces.

According to the present invention there is provided a road mat which includes a body having a first end, a second end, a first face and a second face. A first coupling is positioned at the first end. The first coupling has an outwardly extending portion extending outwardly from the first end adjacent to the second face, an angled portion extending from a remote end of the outwardly extending portion toward but not past the first face, and an inwardly extending retaining lip extending from a remote end of the angled portion back toward the first end. A second coupling is positioned at the second end. The second coupling has an outwardly extending portion extending outwardly from the second end adjacent to the first face, an angled portion extending from a remote end of the outwardly extending portion toward but not past the second face, and an inwardly extending retaining lip extending from a remote end of the angled portion back toward the second end. The second coupling is adapted to engage the first coupling of an adjacent body. The retaining lip of the second coupling engages the retaining lip of the first coupling preventing separation.

The road mat, as described above, when interlocked to form a road is less susceptible to separation as weight from a vehicle is transferred along the road from one road mat to an adjacent road mat. The retaining lip of the second coupling engages the retaining lip of the first coupling to ensure that separation does not occur.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 3:
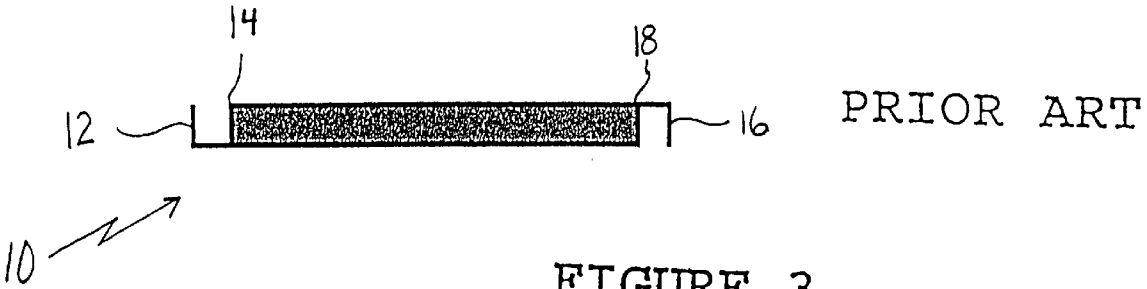
FIG. 3 labelled as PRIOR ART is a side elevation view of a road mat constructed in accordance with teachings known in the art.
Figure 4:
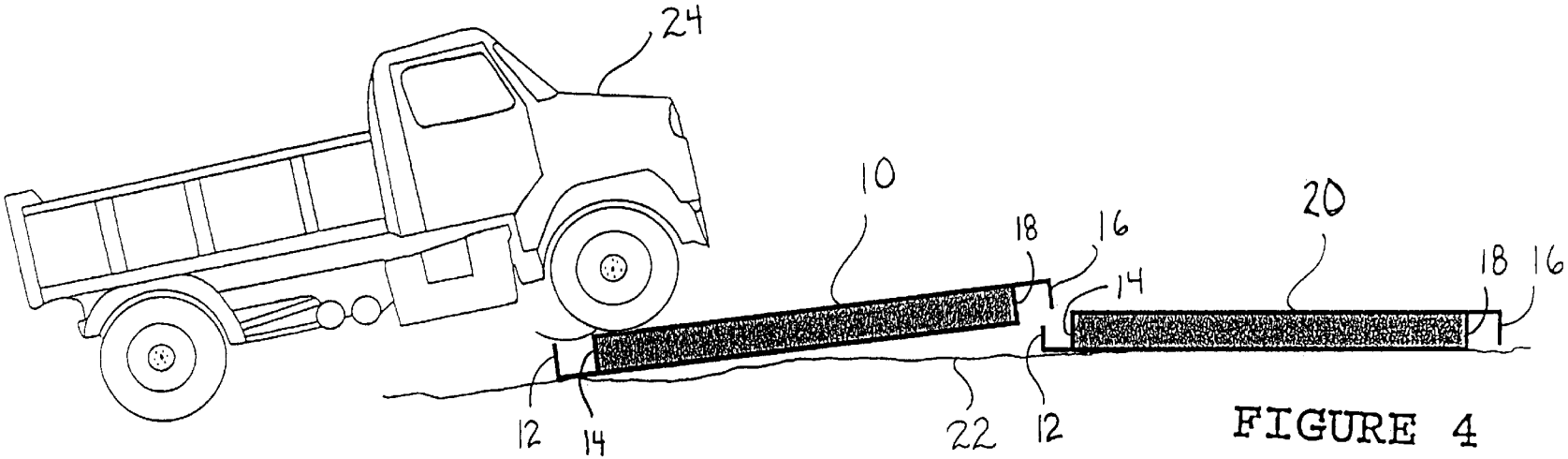
FIG. 4 is a side elevation view of the road mat illustrated in FIG. 3, when subjected to uneven loading.

The preferred embodiment, a road mat generally identified by reference numeral 10, will now be described with reference to FIGS. 1 and 2. FIGS. 3 and 4 will be used to describe the shortcomings in the prior art which gave rise to the present invention.

Review of the Prior Art

Referring to FIG. 3, there is provided a mat 10 with a first "L" shaped appendage 12 extending outwardly and upwardly from a first end 14 and a second "L" shaped appendage 16 extending outwardly and downwardly from a second end 18 of mat 10. Referring to FIG. 4, the engagement of first "L" shaped appendage 12 of mat 10 with second "L" shaped appendage 16 of adjacent mat 20 prevents axial movement. This engagement works effectively when an underlying surface 22 is firm. However, when underlying surface 22 is soft, spongy or uneven, the engagement is not effective. On such surfaces 22, road mats 10 tend to tip up when weight is exerted upon first end 14. This tipping movement is encountered both as a motor vehicle 24 first drives onto road mat 10 and as motor vehicle 24 drives off road mat 10. When subjected to this tipping movement, road mat 10 and adjacent road mat 20 tend to separate.

Structure and Relationship of Parts

Figure 1:
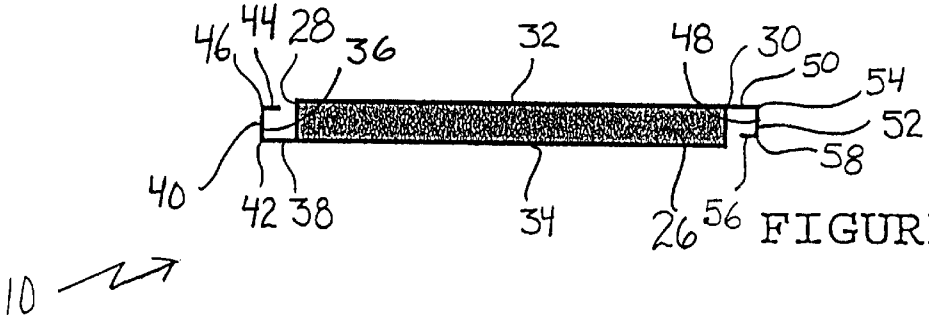
FIG. 1 is a side elevation view of a road mat constructed in accordance with the teachings of the present invention.

Referring to FIG. 1, there is provided a road mat 10 that includes a body 26 with a first end 28, a second end 30, a first face 32 and a second face 34. A first coupling 36 is provided at first end 28. First coupling 36 has an outwardly extending portion 38 that extends outwardly from first end 28 adjacent to second face 34, an angled portion 40 that extends from a remote end 42 of outwardly extending portion 38 toward but not past first face 32, and an inwardly extending retaining lip 44 that extends from a remote end 46 of angled portion 40 back toward first end 28.

A second coupling 48 is provided at second end 30 of road mat 10. Second coupling 48 has an outwardly extending portion 50 that extends outwardly from second end 30 adjacent to first face 32, an angled portion 52 extending from a remote end 54 of outwardly extending portion 50 toward but not past second face 34, and an inwardly extending retaining lip 56 extending from a remote end 58 of angled portion 52 back toward second end 30.

Figure 2:
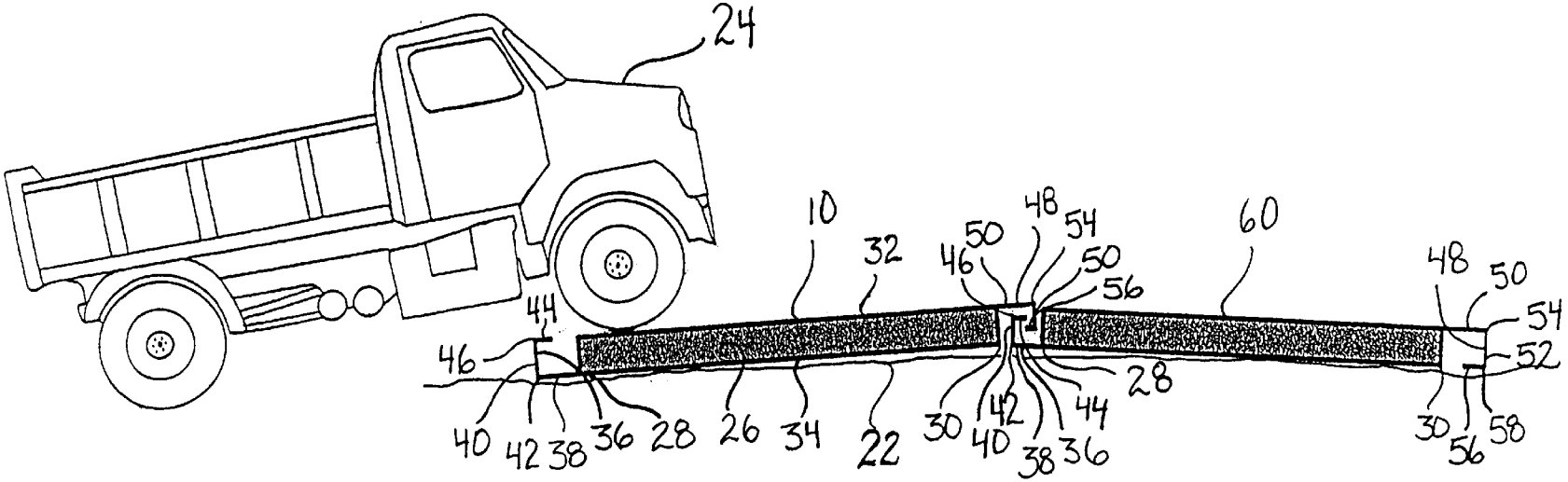
FIG. 2 is a side elevation view of the road mat illustrated in FIG. 1, when subjected to uneven loading.

Referring to FIG. 2, second coupling 48 is adapted to engage first coupling 36 of an adjacent body 60 with retaining lip 56 of second coupling 48 engaging retaining lip 44 of first coupling 36 to prevent separation.

Operation

The use and operation of road mats 10 will now be described with reference to FIGS. 1 through 4. Referring to FIG. 2, road mats 10 are designed to be laid on ground surface 22 in end to end relation and driven over by motor vehicle 24. Mats 10 are secured together by interlocking second coupling 48 of road mat 10 with first coupling 36 of adjacent mat 60. Second coupling 48 is adapted to engage first coupling 36 of adjacent body 60 such that retaining lip 56 of second coupling 48 engages retaining lip 44 of first coupling 36 to prevent separation.

As motor vehicle 24 first drives onto road mat 10 and as motor vehicle 24 drives off road mat 10, the weight of vehicle 24 will cause a tipping movement to occur. When subjected to this tipping movement, second end 30 of road mat 10 will rise slightly and drawing with it first end 28 of adjacent road mat 60. Road mat 10 will not separate from adjacent road mat 60 as retaining lip 56 of second coupling 48 engages retaining lip 44 of first coupling 36 to prevent separation thereby transferring weight from vehicle 24 from road mat 10 to each adjacent road mat 60.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A road mat, comprising:

a body having a first end, a second end, a first face and a second face;

a first coupling at the first end, the first coupling having an outwardly extending portion extending outwardly from the first end adjacent to the second face, an angled portion extending from a remote end of the outwardly extending portion adjacent to but not past the first face, and an inwardly extending retaining lip extending from a remote end of the angled portion back toward the first end;

a second coupling at the second end, the second coupling having an outwardly extending portion extending outwardly from the second end adjacent to the first face, an angled portion extending from a remote end of the outwardly extending portion adjacent to but not past the second face, and an inwardly extending retaining lip extending from a remote end of the angled portion back toward the second end; and the second coupling being substantially identical to the first coupling, the length of the angled portion of the first coupling and the length of the angled portion of the second coupling accommodating limited relative vertical movement with the second coupling being adapted to engage the first coupling of an adjacent body with the retaining lip of the second coupling engaging the retaining lip of the first coupling preventing vertical separation.

2. An interlocking road mat comprising:

a body having a first end, a second end, a first face and a second face;

a first coupling at the first end of the body, the first coupling having an outwardly extending portion extending outwardly from the first end parallel to a plane defined by the second face, an angled portion extending from and normal to a remote end of the outwardly extending portion adjacent to but not past the first face, a single retaining lip which is an inwardly extending retaining lip extending from a remote end of the angled portion back toward the first end and parallel to a plane defined by the first face, and a first passage being defined between a remote end of the single inwardly extending retaining lip of the first coupling and the body with the first passage being substantially larger in dimension than a thickness of a single angled portion of a second coupling of a mating second road mat to facilitate limited lateral movement of the mating second road mat relative to the first road mat;

a second coupling at the second end of the body, the second coupling having an outwardly extending portion extending outwardly from the second end parallel to a plane defined by the first face, an angled portion extending from and normal to a remote end of the outwardly extending portion adjacent to but not past a plane defined by the second face, a single retaining lip which is an inwardly extending retaining lip extending from a remote end of the angled portion back toward the second end and parallel to the plane defined by the second face, and a second passage being defined between a remote end of the single inwardly extending retaining lip of the second coupling and the body with the second passage being substantially larger in dimension than a thickness of an angled portion of a first coupling of a mating third road mat to facilitate limited lateral movement of the mating third road mat relative to the first road mat; and the second coupling being substantially identical to the first coupling but oriented in an opposed relationship to facilitate engagement of the first coupling of the road mat with the second coupling of the mating second road mat and engagement of the second coupling of the road mat with the first coupling of the mating third road mat.

3. The road mat of claim 2, wherein the first and second couplings each have a generally J-shaped transverse cross section, and the passage of the first coupling faces upward while the passage of the second coupling faces downward.

4. The road mat of claim 3, wherein the outwardly extending portion, the angled portion and the retaining lip, of each J-shaped transverse cross section, define a cavity therebetween for retaining the retaining lip of another mating road mat, and the cavity allows limited movement of the retaining lip of the another mating road mat therein while still captively retaining the retaining lip to the another mating road mat of within the cavity.

5. The road mat of claim 2, wherein vertical movement of a single retaining lip of the second coupling of the second road mat, when engaged with the cavity of the first coupling of the road mat, is confined by the outwardly extending portion of the first coupling of the road mat and the single retaining lip of the first coupling of the road mat; and vertical movement of a single retaining lip of a first coupling of a third road mat, when engaged with the cavity of the second coupling of the road mat, is confined by the outwardly extending portion of the second coupling of the road mat and the single retaining lip of the second coupling of the road mat.

6. The road mat of claim 2, wherein horizontal movement of an angled portion of a second coupling of a second road mat, when engaged with the cavity of the first coupling of the road mat, is confined by the single retaining lip of the first coupling of the road mat and the body of the road mat; and horizontal movement of an angled portion of a first coupling of a third road mat, when engaged with the cavity of the second coupling of the road mat, is confined by the single retaining lip of the second coupling of the road mat and the body of the road mat.

7. The road mat of claim 2, wherein the retaining lip of the first coupling is coincident with a plane extending parallel to and located between the first and second faces, and the retaining lip of the second coupling is coincident with a plane extending parallel to and located between the first and second faces.

8. The road mat of claim 3, wherein the outwardly extending portion, the angled portion and the retaining lip, of each J-shaped transverse cross section, define a cavity therebetween for retaining the retaining lip of a mating road mat, and the cavity allows limited movement of the retaining lip of the mating road mat therein while still captively retaining the retaining lip of the mating road mat within the cavity.

9. The road mat of claim 8, wherein vertical movement of a single retaining lip of a second coupling of a second road mat, when engaged with the cavity of the first coupling of the road mat, is confined by the outwardly extending portion of the first coupling of the road mat and the single retaining lip of the first coupling of the road mat; and vertical movement of a single retaining lip of a first coupling of a third road mat, when engaged with the cavity of the second coupling of the road mat, is confined by the outwardly extending portion of the second coupling of the road mat and the single retaining lip of the second coupling of the road mat.

10. The road mat of claim 9, wherein horizontal movement of an angled portion of a second coupling of a second road mat, when engaged with the cavity of the first coupling of the road mat, is confined by the single retaining lip of the first coupling of the road mat and the body of the road mat; and horizontal movement of an angled portion of a first coupling of a third road mat, when engaged with the cavity of the second coupling of the road mat, is confined by the single retaining lip of the second coupling of the road mat and the body of the road mat.

11. The road mat of claim 10, wherein the retaining lip of the first coupling is coincident with a plane extending parallel to and located between the first and second faces, and the retaining lip of the second coupling is coincident with a plane extending parallel to and located between the first and second faces.

12. An interlocking road mat system comprising at least first and second road mats with each of the first and second road mats comprising:

a body having a first end, a second end, a first face and a second face;

a first coupling at the first end of the body, the first coupling having an outwardly extending portion extending outwardly from the first end parallel to a plane defined by the second face, an angled portion extending from and normal to a remote end of the outwardly extending portion adjacent to but not past the first face, a single retaining lip which is an inwardly extending retaining lip extending from a remote end of the angled portion back toward the first end and parallel to a plane defined by the first face, and a first passage being defined between a remote end of the single inwardly extending retaining lip of the first coupling and the body with the first passage being substantially larger in dimension than a thickness of a single angled portion of a second coupling of a mating second road mat to facilitate limited lateral movement of the mating second road mat relative to the first road mat;

a second coupling at the second end of the body, the second coupling having an outwardly extending portion extending outwardly from the second end parallel to a plane defined by the first face, an angled portion extending from and normal to a remote end of the outwardly extending portion adjacent to but not past a plane defined by the second face, a single retaining lip which is an inwardly extending retaining lip extending from a remote end of the angled portion back toward the second end and parallel to the plane defined by the second face, and a second passage being defined between a remote end of the single inwardly extending retaining lip of the second coupling and the body with the second passage being substantially larger in dimension than a thickness of an angled portion of a first coupling of a mating third road mat to facilitate limited lateral movement of the mating third road mat relative to the first road mat; and the second coupling being substantially identical to the first coupling but oriented in an opposed relationship to facilitate engagement of the first coupling of the road mat with the second coupling of the mating second road mat and engagement of the second coupling of the road mat with the first coupling of the mating third road mat.

13. The road mat of claim 12, wherein the first and second couplings each have a generally J-shaped transverse cross section, and the passage of the first coupling faces upward while the passage of the second coupling faces downward and the outwardly extending portion, the angled portion and the retaining lip, of each J-shaped transverse cross section, define a cavity therebetween for retaining the retaining lip of another mating road mat, and the cavity allows limited movement of the retaining lip of the another mating road mat therein while still captively retaining the retaining lip the another mating road mat of within the cavity.

14. The road mat of claim 13, wherein vertical movement of a single retaining lip of the second coupling of the second road mat, when engaged with the cavity of the first coupling of the road mat, is confined by the outwardly extending portion of the first coupling of the road mat and the single retaining lip of the first coupling of the road mat; and vertical movement of a single retaining lip of a first coupling of a third road mat, when engaged with the cavity of the second coupling of the road mat, is confined by the outwardly extending portion of the second coupling of the road mat and the single retaining lip of the second coupling of the road mat.

15. The road mat of claim 14, wherein horizontal movement of an angled portion of a second coupling of a second road mat, when engaged with the cavity of the first coupling of the road mat, is confined by the single retaining lip of the first coupling of the road mat and the body of the road mat; and horizontal movement of an angled portion of a first coupling of a third road mat, when engaged with the cavity of the second coupling of the road mat, is confined by the single retaining lip of the second coupling of the road mat and the body of the road mat.

16. The road mat of claim 15, wherein the retaining lip of the first coupling is coincident with a plane extending parallel to and located between the first and second faces, and the retaining lip of the second coupling is coincident with a plane extending parallel to and located between the first and second faces.

* * * * *